US012276190B2

(12) United States Patent
Al-Mousa et al.

(10) Patent No.: US 12,276,190 B2
(45) Date of Patent: Apr. 15, 2025

(54) ULTRASONIC FLOW CHECK SYSTEMS FOR WELLBORES

(71) Applicant: Saudi Arabian Oil Company, Dhahran (SA)

(72) Inventors: Ahmed Al-Mousa, Dhahran (SA); Hassan K. Al-Aswad, Al Qatif (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 403 days.

(21) Appl. No.: 17/651,268

(22) Filed: Feb. 16, 2022

(65) Prior Publication Data

US 2023/0258070 A1 Aug. 17, 2023

(51) Int. Cl.
*E21B 47/047* (2012.01)
*E21B 21/08* (2006.01)
*E21B 47/12* (2012.01)

(52) U.S. Cl.
CPC ..... *E21B 47/047* (2020.05); *E21B 21/08* (2013.01); *E21B 47/138* (2020.05)

(58) Field of Classification Search
CPC ..... E21B 47/047; E21B 47/138; E21B 21/08; G01F 23/28; G01F 23/292
See application file for complete search history.

(56) References Cited

U.S. PATENT DOCUMENTS 462,431 A 11/1891 McMullin
792,191 A 8/1904 Blameuser
880,404 A 2/1908 Sanford
1,033,655 A 7/1912 Baker
1,258,273 A 3/1918 Titus et al.
1,392,650 A 10/1921 Mcmillian
1,491,066 A 4/1924 Patrick
(Continued)

FOREIGN PATENT DOCUMENTS

AU 636642 5/1993
AU 2007249417 11/2007
(Continued)

OTHER PUBLICATIONS

U.S. Appl. No. 17/131,352, filed Dec. 22, 2020, Al-Mousa et al.
(Continued)

*Primary Examiner* — Jennifer Bahls
*Assistant Examiner* — Quang X Nguyen
(74) *Attorney, Agent, or Firm* — Fish & Richardson P.C.

(57) ABSTRACT

An ultrasonic flow check system for wellbores includes an ultrasonic transceiver installed within an inner surface of a bell nipple attached to a well head of a wellbore at a surface. The bell nipple receives wellbore fluid from a flow line attached to a side surface of the bell nipple. An alarm is installed on a rotary table installed above the bell nipple such that the bell nipple is between the rotary table and the well head. A ultrasonic signal is caused to be transmitted, by the ultrasonic transceiver, into the bell nipple. The ultrasonic signal is reflected by the wellbore fluid within the bell nipple resulting in an ultrasonic response signal. The ultrasonic response signal is caused to be received by the ultrasonic transceiver. Based on the ultrasonic response signal, it is determined whether the fluid level within the bell nipple is static or mobile.

19 Claims, 3 Drawing Sheets

(56) References Cited

U.S. PATENT DOCUMENTS 1,580,352 A 4/1926 Ercole
1,591,264 A 7/1926 Baash
1,621,947 A 3/1927 Moore
1,638,494 A 8/1927 Lewis et al.
1,789,993 A 1/1931 Switzer
1,796,762 A 3/1931 Paston
1,843,217 A 2/1932 Fletcher
1,896,236 A 2/1933 Howard
1,896,482 A 2/1933 Crowell
1,897,297 A 2/1933 Brown
1,906,933 A 5/1933 Standlee
1,949,498 A 3/1934 Frederick et al.
1,979,500 A 11/1934 Sniffin
2,047,774 A 7/1936 Greene
2,121,002 A 6/1938 Baker
2,121,051 A 6/1938 Ragan et al.
2,187,487 A 1/1940 Burt
2,189,697 A 2/1940 Baker
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,377,249 A 5/1945 Lawrence
2,411,260 A 11/1946 Glover et al.
2,481,637 A 9/1949 Yancey
2,546,978 A 4/1951 Collins et al.
2,638,988 A 5/1953 Williams
2,663,370 A 12/1953 Robert et al.
2,672,199 A 3/1954 McKenna
2,701,019 A 2/1955 Steed
2,707,998 A 5/1955 Baker et al.
2,708,973 A 5/1955 Twining
2,728,599 A 12/1955 Moore
2,734,581 A 2/1956 Bonner
2,745,693 A 5/1956 Mcgill
2,751,010 A 6/1956 Trahan
2,762,438 A 9/1956 Naylor
2,778,428 A 1/1957 Baker et al.
2,806,532 A 9/1957 Baker et al.
2,874,781 A 2/1959 McGaffey
2,881,838 A 4/1959 Morse et al.
2,887,162 A 5/1959 Le Bus et al.
2,912,053 A 11/1959 Bruekelman
2,912,273 A 11/1959 Chadderdon et al.
2,915,127 A 12/1959 Abendroth
2,935,020 A 5/1960 Howard et al.
2,947,362 A 8/1960 Smith
2,965,175 A 12/1960 Ransom
2,965,177 A 12/1960 Le Bus et al.
2,965,183 A 12/1960 Le Bus et al.
2,992,740 A 7/1961 Phippen
3,005,506 A 10/1961 Le Bus et al.
3,023,810 A 3/1962 Anderson
3,116,799 A 1/1964 Lemons
3,147,536 A 9/1964 Lamphere
3,187,238 A 6/1965 Wilson et al.
3,191,677 A 6/1965 Kinley
3,225,828 A 12/1965 Wisenbaker et al.
3,255,821 A 6/1966 Curlet
3,308,886 A 3/1967 Evans
3,352,593 A 11/1967 Webb
3,369,603 A 2/1968 Trantham
3,376,934 A 4/1968 William
3,380,528 A 4/1968 Durwood
3,381,748 A 5/1968 Peters et al.
3,382,925 A 5/1968 Jennings
3,409,084 A 11/1968 Lawson, Jr. et al.
3,433,313 A 3/1969 Brown
3,437,136 A 4/1969 Young
3,504,793 A 4/1970 More
3,554,278 A 1/1971 Reistle
3,667,721 A 6/1972 Vujasinovic
3,747,674 A 7/1973 Murray
3,752,230 A 8/1973 Bernat et al.
3,833,337 A 9/1974 Desty et al.
3,885,629 A 5/1975 Erb et al.
3,897,038 A 7/1975 Le Rouax
3,915,426 A 10/1975 Le Rouax
3,955,622 A 5/1976 Jones
4,030,354 A 6/1977 Scott
4,039,237 A 8/1977 Cullen et al.
4,039,798 A 8/1977 Lyhall et al.
4,042,019 A 8/1977 Henning
4,059,155 A 11/1977 Greer
4,099,699 A 7/1978 Allen
4,158,388 A 6/1979 Owen
4,190,112 A 2/1980 Davis
4,203,472 A 5/1980 Dulaney
4,212,240 A 7/1980 Lee et al.
4,215,747 A 8/1980 Cox
4,227,573 A 10/1980 Pearce et al.
4,254,983 A 3/1981 Harris
4,265,611 A 5/1981 Reed et al.
4,276,931 A 7/1981 Murray
4,285,400 A 8/1981 Mullins
4,289,200 A 9/1981 Fisher
4,296,822 A 10/1981 Ormsby
4,325,534 A 4/1982 Roark et al.
4,336,017 A 6/1982 Desty
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,438,652 A * 3/1984 Saito ..... G01F 1/663
73/861.25
4,458,521 A 7/1984 Pillette
4,467,996 A 8/1984 Baugh
4,478,286 A 10/1984 Fineberg
4,505,668 A 3/1985 Dibiano et al.
4,515,212 A 5/1985 Krugh
4,538,684 A 9/1985 Sheffield
4,562,888 A 1/1986 Collet
4,603,578 A 8/1986 Stolz
4,611,658 A 9/1986 Salerni et al.
4,616,721 A 10/1986 Furse
4,696,502 A 9/1987 Desai
4,735,268 A 4/1988 Harris
4,791,992 A 12/1988 Greenlee et al.
4,834,184 A 5/1989 Streich et al.
4,836,289 A 6/1989 Young
4,869,321 A 9/1989 Hamilton
4,877,085 A 10/1989 Pullig, Jr.
4,898,240 A 2/1990 Wittrisch
4,898,245 A 2/1990 Braddick
4,928,762 A 5/1990 Mamke
4,953,617 A 9/1990 Ross et al.
4,997,225 A 3/1991 Denis
5,012,863 A 5/1991 Springer
5,013,005 A 5/1991 Nance
5,054,833 A 10/1991 Bishop et al.
5,060,737 A 10/1991 Mohn
5,117,909 A 6/1992 Wilton et al.
5,129,956 A 7/1992 Christopher et al.
5,139,089 A 8/1992 Wacker
5,176,208 A 1/1993 Lalande et al.
5,178,219 A 1/1993 Streich et al.
5,197,547 A 3/1993 Morgan
5,203,646 A 4/1993 Landsberger et al.
5,255,982 A 10/1993 Zimmer
5,295,541 A 3/1994 Ng et al.
5,330,000 A 7/1994 Givens et al.
5,343,946 A 9/1994 Morrill
5,348,095 A 9/1994 Worrall
5,358,048 A 10/1994 Brooks
5,392,715 A 2/1995 Pelrine
5,456,312 A 10/1995 Lynde et al.
5,468,153 A 11/1995 Brown et al.
5,505,426 A 4/1996 Whitby
5,507,346 A 4/1996 Gano et al.
5,580,114 A 12/1996 Palmer
5,584,342 A 12/1996 Swinford

(56) References Cited

U.S. PATENT DOCUMENTS

| | | | |
|---|---|---|---|
| 5,605,366 | A | 2/1997 | Beeman |
| 5,639,135 | A | 6/1997 | Beeman |
| 5,667,015 | A | 9/1997 | Harestad et al. |
| 5,673,754 | A | 10/1997 | Taylor |
| 5,678,635 | A | 10/1997 | Dunlap et al. |
| 5,685,982 | A | 11/1997 | Foster |
| 5,697,441 | A | 12/1997 | Vercaemer et al. |
| 5,698,814 | A | 12/1997 | Parsons |
| 5,704,426 | A | 1/1998 | Rytlewski et al. |
| 5,775,420 | A | 7/1998 | Mitchell et al. |
| 5,806,596 | A | 9/1998 | Hardy et al. |
| 5,832,547 | A | 11/1998 | Burroughs |
| 5,833,001 | A | 11/1998 | Song et al. |
| 5,842,518 | A | 12/1998 | Soybel et al. |
| 5,875,841 | A | 3/1999 | Wright et al. |
| 5,881,816 | A | 3/1999 | Wright |
| 5,887,668 | A | 3/1999 | Haugen et al. |
| 5,899,796 | A | 5/1999 | Kamiyama et al. |
| 5,924,489 | A | 7/1999 | Hatcher |
| 5,931,443 | A | 8/1999 | Corte, Sr. |
| 5,944,101 | A | 8/1999 | Hearn |
| 5,996,712 | A | 12/1999 | Boyd |
| 6,070,665 | A | 6/2000 | Singleton et al. |
| 6,112,809 | A | 9/2000 | Angle |
| 6,130,615 | A | 10/2000 | Poteet |
| 6,131,675 | A | 10/2000 | Anderson |
| 6,138,764 | A | 10/2000 | Scarsdale et al. |
| 6,155,428 | A | 12/2000 | Bailey et al. |
| 6,247,542 | B1 | 6/2001 | Kruspe et al. |
| 6,276,452 | B1 | 8/2001 | Davis et al. |
| 6,371,204 | B1 | 4/2002 | Singh et al. |
| 6,378,627 | B1 | 4/2002 | Tubel et al. |
| 6,478,086 | B1 | 11/2002 | Hansen |
| 6,484,816 | B1 | 11/2002 | Koederitz |
| 6,491,108 | B1 | 12/2002 | Slup et al. |
| 6,510,900 | B2 | 1/2003 | Dallas |
| 6,510,947 | B1 | 1/2003 | Schulte et al. |
| 6,595,289 | B2 | 7/2003 | Tumlin et al. |
| 6,637,511 | B2 | 10/2003 | Linaker |
| 6,679,330 | B1 | 1/2004 | Compton et al. |
| 6,681,858 | B2 | 1/2004 | Streater |
| 6,688,386 | B2 | 2/2004 | Cornelssen |
| 6,698,712 | B2 | 3/2004 | Milberger et al. |
| 6,719,056 | B2 | 4/2004 | Hoffman et al. |
| 6,729,392 | B2 | 5/2004 | DeBerry et al. |
| 6,768,106 | B2 | 7/2004 | Gzara et al. |
| 6,772,839 | B1 | 8/2004 | Bond |
| 6,808,023 | B2 | 10/2004 | Smith et al. |
| 6,811,032 | B2 | 11/2004 | Schulte et al. |
| 6,843,317 | B2 | 1/2005 | Mackenzie |
| 6,854,521 | B2 | 2/2005 | Echols et al. |
| 6,880,639 | B2 | 4/2005 | Rhodes et al. |
| 6,899,178 | B2 | 5/2005 | Tubel |
| 6,913,084 | B2 | 7/2005 | Boyd |
| 7,000,888 | B2 | 2/2006 | Wright |
| 7,049,272 | B2 | 5/2006 | Sinclair et al. |
| 7,051,810 | B2 | 5/2006 | Halliburton |
| 7,082,994 | B2 | 8/2006 | Frost, Jr. et al. |
| 7,090,019 | B2 | 8/2006 | Barrow et al. |
| 7,096,950 | B2 | 8/2006 | Howlett et al. |
| 7,117,941 | B1 | 10/2006 | Gano |
| 7,117,956 | B2 | 10/2006 | Grattan et al. |
| 7,128,146 | B2 | 10/2006 | Baugh |
| 7,150,328 | B2 | 12/2006 | Marketz et al. |
| 7,174,764 | B2 | 2/2007 | Oosterling et al. |
| 7,188,674 | B2 | 3/2007 | McGavern, III et al. |
| 7,188,675 | B2 | 3/2007 | Reynolds |
| 7,218,235 | B1 | 5/2007 | Rainey |
| 7,231,975 | B2 | 6/2007 | Lavaure et al. |
| 7,249,633 | B2 | 7/2007 | Ravensbergen et al. |
| 7,255,178 | B2 | 8/2007 | Slup et al. |
| 7,267,179 | B1 | 9/2007 | Abel |
| 7,275,591 | B2 | 10/2007 | Allen et al. |
| 7,284,611 | B2 | 10/2007 | Reddy et al. |
| 7,303,010 | B2 | 12/2007 | de Guzman et al. |
| 7,334,634 | B1 | 2/2008 | Abel |
| 7,354,265 | B2 | 4/2008 | Mashhour et al. |
| 7,363,860 | B2 | 4/2008 | Wilson |
| 7,367,412 | B2 | 5/2008 | Barbera |
| 7,374,146 | B2 | 5/2008 | Whitby |
| 7,383,889 | B2 | 6/2008 | Ring |
| 7,389,817 | B2 | 6/2008 | Almdahl |
| 7,398,832 | B2 | 7/2008 | Brisco |
| 7,405,182 | B2 | 7/2008 | Verrett |
| 7,418,860 | B2 | 9/2008 | Austerlitz et al. |
| 7,424,909 | B2 | 9/2008 | Roberts et al. |
| 7,448,446 | B2 | 11/2008 | Campbell |
| 7,487,837 | B2 | 2/2009 | Bailey et al. |
| 7,488,705 | B2 | 2/2009 | Reddy et al. |
| 7,497,260 | B2 | 3/2009 | Telfer |
| 7,533,731 | B2 | 5/2009 | Corre |
| 7,591,305 | B2 | 9/2009 | Brookey et al. |
| 7,600,572 | B2 | 10/2009 | Slup et al. |
| 7,617,876 | B2 | 11/2009 | Patel et al. |
| 7,621,324 | B2 | 11/2009 | Atencio |
| 7,712,527 | B2 | 5/2010 | Roddy |
| 7,730,974 | B2 | 6/2010 | Minshull |
| 7,735,564 | B2 | 6/2010 | Guerrero |
| 7,762,323 | B2 | 7/2010 | Frazier |
| 7,762,330 | B2 | 7/2010 | Saylor, III et al. |
| 7,802,621 | B2 | 9/2010 | Richards et al. |
| 7,878,240 | B2 | 2/2011 | Garcia |
| 7,921,917 | B2 | 4/2011 | Kotrla et al. |
| 7,934,552 | B2 | 5/2011 | La Rovere |
| 7,946,273 | B2 | 5/2011 | Lippa et al. |
| 7,965,175 | B2 | 6/2011 | Yamano |
| 8,002,049 | B2 | 8/2011 | Keese et al. |
| 8,056,621 | B2 | 11/2011 | Ring et al. |
| 8,069,916 | B2 | 12/2011 | Giroux et al. |
| 8,138,927 | B2 | 3/2012 | Diepenbroek et al. |
| 8,157,007 | B2 | 4/2012 | Nicolas |
| 8,201,693 | B2 | 6/2012 | Jan |
| 8,210,251 | B2 | 7/2012 | Lynde et al. |
| 8,275,538 | B2 | 9/2012 | Surnilla et al. |
| 8,282,389 | B2 | 10/2012 | Dhulst et al. |
| 8,376,051 | B2 | 2/2013 | McGrath et al. |
| 8,424,611 | B2 | 4/2013 | Smith et al. |
| 8,453,724 | B2 | 6/2013 | Zhou |
| 8,496,055 | B2 | 7/2013 | Mootoo et al. |
| 8,579,024 | B2 | 11/2013 | Mailand et al. |
| 8,579,037 | B2 | 11/2013 | Jacob |
| 8,596,463 | B2 | 12/2013 | Burkhard |
| 8,662,182 | B2 | 3/2014 | Redlinger et al. |
| 8,708,043 | B2 | 4/2014 | Mosing et al. |
| 8,726,983 | B2 | 5/2014 | Khan |
| 8,757,273 | B2 | 6/2014 | Themig et al. |
| 8,770,276 | B1 | 7/2014 | Nish et al. |
| 8,888,671 | B2 | 11/2014 | Paulsen |
| 8,899,338 | B2 | 12/2014 | Elsayed et al. |
| 8,936,097 | B2 | 1/2015 | Heijnen |
| 8,991,489 | B2 | 3/2015 | Redlinger et al. |
| 8,991,505 | B2 | 3/2015 | Fleckenstein et al. |
| 9,079,222 | B2 | 7/2015 | Burnett et al. |
| 9,109,433 | B2 | 8/2015 | DiFoggio et al. |
| 9,133,671 | B2 | 9/2015 | Kellner |
| 9,142,111 | B2 | 9/2015 | Fernandes et al. |
| 9,163,469 | B2 | 10/2015 | Broussard et al. |
| 9,181,782 | B2 | 11/2015 | Berube et al. |
| 9,200,486 | B2 | 12/2015 | Leveau et al. |
| 9,212,532 | B2 | 12/2015 | Leuchtenberg et al. |
| 9,234,394 | B2 | 1/2016 | Wheater et al. |
| 9,303,482 | B2 | 4/2016 | Hall et al. |
| 9,328,585 | B2 | 5/2016 | Groesbeck et al. |
| 9,335,232 | B2 | 5/2016 | Scheucher |
| 9,353,589 | B2 | 5/2016 | Hekelaar |
| 9,359,861 | B2 | 6/2016 | Burgos |
| 9,410,066 | B2 | 8/2016 | Ghassemzadeh |
| 9,416,617 | B2 | 8/2016 | Wiese et al. |
| 9,441,441 | B1 | 9/2016 | Hickie |
| 9,441,451 | B2 | 9/2016 | Jurgensmeier |
| 9,453,374 | B2 | 9/2016 | Sullivan |
| 9,476,279 | B2 | 10/2016 | Bailey et al. |
| 9,528,354 | B2 | 12/2016 | Loiseau et al. |
| 9,551,200 | B2 | 1/2017 | Read et al. |

(56) References Cited

U.S. PATENT DOCUMENTS

| | | | |
|---|---|---|---|
| 9,562,339 | B2 | 2/2017 | Kiest |
| 9,574,417 | B2 | 2/2017 | Laird et al. |
| 9,612,360 | B2 | 4/2017 | Zenith et al. |
| 9,617,829 | B2 | 4/2017 | Dale et al. |
| 9,624,746 | B2 | 4/2017 | Hendel et al. |
| 9,637,977 | B2 | 5/2017 | Giroux et al. |
| 9,657,213 | B2 | 5/2017 | Murphy et al. |
| 9,677,762 | B2 | 6/2017 | Tullos |
| 9,784,073 | B2 | 10/2017 | Bailey et al. |
| 9,863,214 | B2 | 1/2018 | Cronley |
| 9,896,380 | B2 | 2/2018 | Frantz et al. |
| 9,903,192 | B2 | 2/2018 | Entchev |
| 9,951,583 | B2 | 4/2018 | Gosselin et al. |
| 9,976,407 | B2 | 5/2018 | Ash et al. |
| 10,018,011 | B2 | 7/2018 | Van Dongen |
| 10,024,154 | B2 | 7/2018 | Gray et al. |
| 10,087,752 | B2 | 10/2018 | Bedonet |
| 10,161,194 | B2 | 12/2018 | Clemens et al. |
| 10,189,031 | B2 | 1/2019 | Funseth et al. |
| 10,198,929 | B2 | 2/2019 | Snyder |
| 10,202,817 | B2 | 2/2019 | Arteaga |
| 10,266,698 | B2 | 4/2019 | Cano et al. |
| 10,280,706 | B1 | 5/2019 | Sharp, III |
| 10,301,898 | B2 | 5/2019 | Orban |
| 10,301,989 | B2 | 5/2019 | Imada |
| 10,400,552 | B2 | 9/2019 | Gilmore et al. |
| 10,544,640 | B2 | 1/2020 | Hekelaar et al. |
| 10,584,546 | B1 | 3/2020 | Ford |
| 10,626,698 | B2 | 4/2020 | Al-Mousa et al. |
| 10,655,456 | B2 | 5/2020 | Espe |
| 10,787,888 | B2 | 9/2020 | Andersen |
| 10,837,254 | B2 | 11/2020 | Al-Mousa et al. |
| 10,954,739 | B2 | 3/2021 | Sehsah et al. |
| 10,975,645 | B2 | 4/2021 | Al-Mousa et al. |
| 10,975,654 | B1 | 4/2021 | Neacsu et al. |
| 10,982,504 | B2 | 4/2021 | Al-Mousa et al. |
| 11,008,824 | B2 | 5/2021 | Al-Mousa et al. |
| 11,035,190 | B2 | 6/2021 | Neascu et al. |
| 11,105,180 | B2 | 8/2021 | Al-Mousa et al. |
| 11,136,849 | B2 | 10/2021 | Al-Mousa et al. |
| 11,142,976 | B2 | 10/2021 | Al-Mousa et al. |
| 11,156,052 | B2 | 10/2021 | Al-Mousa et al. |
| 11,225,850 | B2 | 1/2022 | Al-Mousa et al. |
| 11,230,904 | B2 | 1/2022 | Al-Mousa et al. |
| 11,268,330 | B2 | 3/2022 | Al-Mousa et al. |
| 11,274,515 | B2 | 3/2022 | Grinnsbo |
| 11,274,549 | B2 | 3/2022 | Al-Mousa et al. |
| 11,286,725 | B2 | 3/2022 | Al-Mousa et al. |
| 2002/0053428 | A1 | 5/2002 | Maples |
| 2002/0060079 | A1 | 5/2002 | Metcalfe |
| 2002/0129945 | A1 | 9/2002 | Brewer et al. |
| 2002/0139528 | A1 | 10/2002 | Surjaatmadja |
| 2002/0195252 | A1 | 12/2002 | Maguire |
| 2003/0047312 | A1 | 3/2003 | Bell |
| 2003/0098064 | A1 | 5/2003 | Kohli et al. |
| 2003/0132224 | A1 | 7/2003 | Spencer |
| 2003/0150608 | A1 | 8/2003 | Smith |
| 2003/0155155 | A1 | 8/2003 | Dewey et al. |
| 2003/0221840 | A1 | 12/2003 | Whitelaw |
| 2004/0031940 | A1 | 2/2004 | Biester |
| 2004/0040707 | A1 | 3/2004 | Dusterhoft et al. |
| 2004/0065446 | A1 | 4/2004 | Tran et al. |
| 2004/0074819 | A1 | 4/2004 | Burnett |
| 2004/0095248 | A1 | 5/2004 | Mandel |
| 2004/0168796 | A1 | 9/2004 | Baugh et al. |
| 2004/0216891 | A1 | 11/2004 | Maguire |
| 2005/0024231 | A1 | 2/2005 | Fincher et al. |
| 2005/0029015 | A1 | 2/2005 | Burnett et al. |
| 2005/0056427 | A1 | 3/2005 | Clemens et al. |
| 2005/0087585 | A1 | 4/2005 | Copperthite et al. |
| 2005/0167097 | A1 | 8/2005 | Sommers et al. |
| 2005/0263282 | A1 | 12/2005 | Jeffrey et al. |
| 2006/0082462 | A1 | 4/2006 | Crook |
| 2006/0105896 | A1 | 5/2006 | Smith et al. |
| 2006/0213656 | A1 | 9/2006 | Clifton |
| 2006/0243453 | A1 | 11/2006 | McKee |
| 2007/0056913 | A1 | 3/2007 | Burt |
| 2007/0114039 | A1 | 5/2007 | Hobdy et al. |
| 2007/0137528 | A1 | 6/2007 | Le Roy-Ddelage et al. |
| 2007/0181304 | A1 | 8/2007 | Rankin et al. |
| 2007/0182583 | A1 | 8/2007 | Feluch et al. |
| 2007/0204999 | A1 | 9/2007 | Cowie et al. |
| 2007/0227722 | A1 | 10/2007 | Atencio |
| 2007/0256864 | A1 | 11/2007 | Robichaux et al. |
| 2007/0256867 | A1 | 11/2007 | DeGeare et al. |
| 2008/0007421 | A1 | 1/2008 | Liu et al. |
| 2008/0066912 | A1 | 3/2008 | Freyer et al. |
| 2008/0078699 | A1 | 4/2008 | Carr |
| 2008/0087439 | A1 | 4/2008 | Dallas |
| 2008/0185148 | A1 | 8/2008 | Carter et al. |
| 2008/0236841 | A1 | 10/2008 | Howlett et al. |
| 2008/0251253 | A1 | 10/2008 | Lumbye |
| 2008/0314591 | A1 | 12/2008 | Hales et al. |
| 2009/0167297 | A1 | 7/2009 | Chee et al. |
| 2009/0194290 | A1 | 8/2009 | Parks et al. |
| 2009/0250220 | A1 | 10/2009 | Stamoulis |
| 2009/0308656 | A1 | 12/2009 | Chitwood |
| 2010/0051265 | A1 | 3/2010 | Hurst |
| 2010/0089583 | A1 | 4/2010 | Xu et al. |
| 2010/0162812 | A1 | 7/2010 | Parkinson |
| 2010/0176956 | A1 | 7/2010 | Moerschell |
| 2010/0193124 | A1 | 8/2010 | Nicolas |
| 2010/0258289 | A1 | 10/2010 | Lynde et al. |
| 2010/0263856 | A1 | 10/2010 | Lynde et al. |
| 2010/0270018 | A1 | 10/2010 | Howlett |
| 2011/0005836 | A1 | 1/2011 | Radford et al. |
| 2011/0036570 | A1 | 2/2011 | La Rovere et al. |
| 2011/0056681 | A1 | 3/2011 | Khan |
| 2011/0067869 | A1 | 3/2011 | Bour et al. |
| 2011/0168411 | A1 | 7/2011 | Braddick |
| 2011/0203794 | A1 | 8/2011 | Moffitt et al. |
| 2011/0259609 | A1 | 10/2011 | Hessels et al. |
| 2011/0273291 | A1 | 11/2011 | Adams |
| 2011/0278021 | A1 | 11/2011 | Travis et al. |
| 2012/0012335 | A1 | 1/2012 | White et al. |
| 2012/0067447 | A1 | 3/2012 | Ryan et al. |
| 2012/0085538 | A1 | 4/2012 | Guerrero |
| 2012/0118571 | A1 | 5/2012 | Zhou |
| 2012/0170406 | A1 | 7/2012 | DiFoggio et al. |
| 2012/0205908 | A1 | 8/2012 | Fischer et al. |
| 2012/0241146 | A1 | 9/2012 | Unnphries |
| 2012/0285684 | A1 | 11/2012 | Crow et al. |
| 2013/0000864 | A1 | 1/2013 | Dirksen et al. |
| 2013/0008647 | A1 | 1/2013 | Dirksen |
| 2013/0062055 | A1 | 3/2013 | Tolman |
| 2013/0134704 | A1 | 5/2013 | Klimack |
| 2013/0140022 | A1 | 6/2013 | Leighton |
| 2013/0213654 | A1 | 8/2013 | Dewey et al. |
| 2013/0226475 | A1 | 8/2013 | Franklin |
| 2013/0240207 | A1 | 9/2013 | Frazier |
| 2013/0269097 | A1 | 10/2013 | Alammari |
| 2013/0296199 | A1 | 11/2013 | Ghassemzadeh |
| 2013/0299194 | A1 | 11/2013 | Bell |
| 2014/0090898 | A1 | 4/2014 | Moriarty |
| 2014/0138091 | A1 | 5/2014 | Fuhst |
| 2014/0158350 | A1 | 6/2014 | Castillo et al. |
| 2014/0175689 | A1 | 6/2014 | Mussig |
| 2014/0231068 | A1 | 8/2014 | Isaksen |
| 2014/0251616 | A1 | 9/2014 | O'Rourke et al. |
| 2014/0311756 | A1 | 10/2014 | Dicke |
| 2015/0013994 | A1 | 1/2015 | Bailey et al. |
| 2015/0021028 | A1 | 1/2015 | Boekholtz |
| 2015/0047132 | A1 | 2/2015 | Sveum |
| 2015/0096738 | A1 | 4/2015 | Atencio |
| 2015/0152704 | A1 | 6/2015 | Tunget |
| 2015/0198009 | A1 | 7/2015 | Bexte |
| 2015/0260397 | A1 | 9/2015 | Talasila et al. |
| 2015/0275649 | A1 | 10/2015 | Orban |
| 2015/0292317 | A1 | 10/2015 | Flores et al. |
| 2016/0046529 | A1 | 2/2016 | Bricco |
| 2016/0076327 | A1 | 3/2016 | Glaser et al. |
| 2016/0084034 | A1 | 3/2016 | Roane et al. |
| 2016/0130914 | A1 | 5/2016 | Steele |
| 2016/0160106 | A1 | 6/2016 | Jamison et al. |

(56) References Cited

U.S. PATENT DOCUMENTS

| | | | |
|---|---|---|---|
| 2016/0177637 | A1 | 6/2016 | Fleckenstein |
| 2016/0237810 | A1 | 8/2016 | Beaman et al. |
| 2016/0281458 | A1 | 9/2016 | Greenlee |
| 2016/0305215 | A1 | 10/2016 | Harris et al. |
| 2016/0340994 | A1 | 11/2016 | Ferguson et al. |
| 2017/0009554 | A1 | 1/2017 | Surjaatnnadja |
| 2017/0044864 | A1 | 2/2017 | Sabins et al. |
| 2017/0058628 | A1 | 3/2017 | Wijk et al. |
| 2017/0067313 | A1 | 3/2017 | Connell et al. |
| 2017/0074061 | A1 | 3/2017 | Goldspink |
| 2017/0089166 | A1 | 3/2017 | Sullivan |
| 2017/0159362 | A1 | 6/2017 | Janes |
| 2017/0254179 | A1 | 9/2017 | Horwell et al. |
| 2018/0010418 | A1 | 1/2018 | VanLue |
| 2018/0030809 | A1 | 2/2018 | Harestad et al. |
| 2018/0058167 | A1 | 3/2018 | Finol et al. |
| 2018/0080318 | A1 | 3/2018 | Schexnaider et al. |
| 2018/0175545 | A1 | 6/2018 | Engel et al. |
| 2018/0187498 | A1 | 7/2018 | Soto et al. |
| 2018/0209565 | A1 | 7/2018 | Lingnau |
| 2018/0216438 | A1 | 8/2018 | Sewell |
| 2018/0236407 | A1 | 8/2018 | Shevitz |
| 2018/0245427 | A1 | 8/2018 | Jimenez et al. |
| 2018/0252069 | A1 | 9/2018 | Abdollah et al. |
| 2018/0340381 | A1 | 11/2018 | Zhou |
| 2018/0355711 | A1 | 12/2018 | Padden |
| 2018/0363407 | A1 | 12/2018 | Kunz |
| 2018/0363424 | A1 | 12/2018 | Schroeder et al. |
| 2019/0024473 | A1 | 1/2019 | Arefi |
| 2019/0049017 | A1 | 2/2019 | McAdam et al. |
| 2019/0087548 | A1 | 3/2019 | Bennett et al. |
| 2019/0093475 | A1 | 3/2019 | Nyhavn et al. |
| 2019/0186232 | A1 | 6/2019 | Ingram |
| 2019/0195035 | A1 | 6/2019 | AlBahrani et al. |
| 2019/0203551 | A1 | 7/2019 | Davis et al. |
| 2019/0284894 | A1 | 9/2019 | Schmidt et al. |
| 2019/0284898 | A1 | 9/2019 | Fagna et al. |
| 2019/0292897 | A1 | 9/2019 | Costa De Oliveira |
| 2019/0301258 | A1 | 10/2019 | Li |
| 2019/0316424 | A1 | 10/2019 | Robichaux et al. |
| 2019/0338615 | A1 | 11/2019 | Landry |
| 2019/0375486 | A1 | 12/2019 | Beckman |
| 2020/0032604 | A1 | 1/2020 | Al-Ramadhan |
| 2020/0032648 | A1 | 1/2020 | Lu et al. |
| 2020/0040707 | A1 | 2/2020 | Watts et al. |
| 2020/0056446 | A1 | 2/2020 | Al-Mousa et al. |
| 2020/0115976 | A1 | 4/2020 | Zeidler |
| 2020/0224511 | A1 | 7/2020 | Dannish |
| 2020/0240225 | A1 | 7/2020 | King et al. |
| 2020/0325741 | A1 | 10/2020 | Hutchinson et al. |
| 2020/0325746 | A1 | 10/2020 | Lerbrekk |
| 2021/0025259 | A1 | 1/2021 | Al-Mousa et al. |
| 2021/0054696 | A1 | 2/2021 | Golinowski et al. |
| 2021/0054706 | A1 | 2/2021 | Al-Mousa et al. |
| 2021/0054708 | A1 | 2/2021 | Al-Mousa et al. |
| 2021/0054710 | A1 | 2/2021 | Neacsu et al. |
| 2021/0054716 | A1 | 2/2021 | Al-Mousa et al. |
| 2021/0131212 | A1 | 5/2021 | Al-Mousa et al. |
| 2021/0131215 | A1 | 5/2021 | Al-Mousa et al. |
| 2021/0140267 | A1 | 5/2021 | Al-Mousa et al. |
| 2021/0180449 | A1 | 6/2021 | Jamison |
| 2021/0198965 | A1 | 7/2021 | Al-Mousa et al. |
| 2021/0215013 | A1 | 7/2021 | Neacsu et al. |
| 2021/0215036 | A1 | 7/2021 | Heath |
| 2021/0230960 | A1 | 7/2021 | Al-Mousa |
| 2021/0262296 | A1 | 8/2021 | Al-Mousa et al. |
| 2021/0262307 | A1 | 8/2021 | Neacsu |
| 2021/0285306 | A1 | 9/2021 | Al Mulhenn |
| 2021/0293094 | A1 | 9/2021 | Al-Mousa et al. |
| 2021/0293135 | A1 | 9/2021 | Al-Mousa et al. |
| 2021/0301631 | A1* | 9/2021 | Li ..... E21B 41/00 |
| 2021/0363839 | A1 | 11/2021 | Al-Mousa et al. |
| 2021/0388693 | A1 | 12/2021 | Machocki |
| 2022/0042389 | A1 | 2/2022 | Al-Mousa et al. |
| 2022/0042390 | A1 | 2/2022 | Al-Mousa et al. |
| 2022/0098949 | A1 | 3/2022 | Grimsbo |

FOREIGN PATENT DOCUMENTS

| | | | |
|---|---|---|---|
| AU | 2012230084 | 9/2012 | |
| AU | 2017225085 | 8/2018 | |
| CA | 1329349 | 5/1994 | |
| CA | 2441138 | 3/2004 | |
| CA | 2624368 | 4/2011 | |
| CA | 2514492 | 10/2012 | |
| CA | 2762217 | 5/2015 | |
| CA | 2719792 | 6/2015 | |
| CA | 2802988 | 10/2015 | |
| CA | 2879985 | 4/2016 | |
| CA | 2734032 | 6/2016 | |
| CN | 203292820 | 11/2013 | |
| CN | 105436067 | 3/2016 | |
| CN | 103785923 | 6/2016 | |
| CN | 105756668 A * | 7/2016 | ..... E21B 21/08 |
| CN | 104712320 | 12/2016 | |
| CN | 107060679 | 8/2017 | |
| CN | 107191152 | 9/2017 | |
| CN | 107227939 | 10/2017 | |
| CN | 108756851 | 11/2018 | |
| CN | 110998059 | 4/2020 | |
| DK | 2545245 | 4/2017 | |
| DK | 2236742 | 8/2017 | |
| EA | 015064 | 4/2011 | |
| EP | 0622522 | 11/1994 | |
| EP | 0792997 | 9/1997 | |
| EP | 1340882 | 10/2005 | |
| EP | 2119867 | 11/2009 | |
| EP | 2309186 | 4/2011 | |
| EP | 2737172 | 6/2014 | |
| EP | 2964874 | 1/2016 | |
| EP | 3135858 | 3/2017 | |
| EP | 2545245 | 4/2017 | |
| ES | 2275961 | 3/2011 | |
| GB | 958734 | 5/1964 | |
| GB | 2021178 | 11/1979 | |
| GB | 2203602 | 10/1988 | |
| GB | 2356415 | 5/2001 | |
| GB | 2392183 | 2/2004 | |
| GB | 2396634 | 6/2004 | |
| GB | 2414586 | 11/2005 | |
| GB | 2425138 | 10/2006 | |
| GB | 2427214 | 12/2006 | |
| GB | 2453279 | 1/2009 | |
| GB | 2492663 | 1/2014 | |
| GB | 2546996 | 8/2017 | |
| GB | 2548768 | 9/2017 | |
| JP | 2001271982 | 10/2001 | |
| JP | 2009505013 | 2/2009 | |
| KR | 20190115662 | 10/2019 | |
| NL | 9201262 | 2/1994 | |
| NO | 333538 | 7/2013 | |
| NO | 20170293 | 8/2018 | |
| OA | 5503 | 4/1981 | |
| RU | 2669969 | 10/2018 | |
| TW | 201603922 | 2/2016 | |
| TW | 201622853 | 7/2016 | |
| WO | WO 1989012728 | 12/1989 | |
| WO | WO 1996039570 | 12/1996 | |
| WO | WO 2002090711 | 11/2002 | |
| WO | WO 2004046497 | 6/2004 | |
| WO | WO 2008106639 | 9/2008 | |
| WO | WO 2010132807 | 11/2010 | |
| WO | WO 2011041562 | 4/2011 | |
| WO | WO 2011045943 | 4/2011 | |
| WO | WO 2012027476 | 3/2012 | |
| WO | WO 2012161854 | 11/2012 | |
| WO | WO 2012164023 | 12/2012 | |
| WO | WO 2013013136 | 1/2013 | |
| WO | WO 2013109248 | 7/2013 | |
| WO | WO 2015112022 | 7/2015 | |
| WO | WO 2016011085 | 1/2016 | |
| WO | WO 2016040310 | 3/2016 | |

(56) References Cited

FOREIGN PATENT DOCUMENTS

| | | |
|---|---|---|
| WO | WO 2016123166 | 8/2016 |
| WO | WO 2016140807 | 9/2016 |
| WO | WO 2017043977 | 3/2017 |
| WO | WO 2017158573 | 9/2017 |
| WO | WO 2017173540 | 10/2017 |
| WO | WO 2018017104 | 1/2018 |
| WO | WO 2018034672 | 2/2018 |
| WO | WO 2018164680 | 9/2018 |
| WO | WO 2019027830 | 2/2019 |
| WO | WO 2019132877 | 7/2019 |
| WO | WO 2019231679 | 12/2019 |
| WO | WO 2021107937 | 6/2021 |
| WO | WO 2021145902 | 7/2021 |
| WO | WO 2022025942 | 2/2022 |

OTHER PUBLICATIONS

U.S. Appl. No. 17/140,298, filed Jan. 4, 2021, Al-Mousa et al.
U.S. Appl. No. 17/144,824, filed Jan. 8, 2021, Al-Mousa et al.
U.S. Appl. No. 17/188,870, filed Mar. 1, 2021, Al-Mousa.
U.S. Appl. No. 17/237,822, filed Apr. 22, 2021, Al-Mousa et al.
U.S. Appl. No. 17/246,904, filed May 3, 2021, Al-Mousa et al.
U.S. Appl. No. 17/323,632, filed May 18, 2021, Al-Shaiji et al.
U.S. Appl. No. 17/329,991, filed May 25, 2021, Madan et al.
U.S. Appl. No. 17/374,505, filed Jul. 13, 2021, Al-Mousa et al.
U.S. Appl. No. 17/405,362, filed Aug. 18, 2021, Al-Mousa.
U.S. Appl. No. 17/510,027, filed Oct. 25, 2021, Al-Mousa.
U.S. Appl. No. 17/549,420, filed Dec. 13, 2021, Al-Mousa.
U.S. Appl. No. 17/648,082, filed Jan. 14, 2022, Al-Mousa.
U.S. Appl. No. 17/650,476, filed Feb. 9, 2022, Al-Mousa.
U.S. Appl. No. 17/651,268, filed Feb. 16, 2022, Al-Mousa et al.
Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.
Al-Ibrahim et al., "Automated Cyclostratigraphic Analysis in Carbonate Mudrocks Using Borehole Images," Article #41425, posted presented at the 2014 AAPG Annual Convention and Exhibition, Search and Discovery, Apr. 6-9, 2014, 4 pages.
Ashcor "Flame Smart EI+," Burner Management Systems, <https://ashcor.com/products/flame-smart-bms/>, 2020, 2 pages.
Bautista et al., "Probability-based Dynamic TimeWarping for Gesture Recognition on RGB-D data," WDIA 2012: Advances in Depth Image Analysis and Application, International Workshop on Depth Image Analysis and Applications, 2012, 126-135, 11 pages.
Boriah et al., "Similarity Measures for Categorical Data: A Comparative Evaluation," presented at the SIAM International Conference on Data Mining, SDM 2008, Apr. 24-26, 2008, 12 pages.
Bruton et al., "Whipstock Options for Sidetracking," Oilfield Review, Spring 2014, 26:1, 10 pages.
Cameron, "NUFLO Liquid Turbine Flow Meters: Accurate Flow Measurement," Camera: Technical Specifications, 2013, 8 pages.
CCSC, "Bell nipple," CCSC Petroleum Equipment Co., Ltd, 2018, retrieved Mar. 21, 2022, retrieved from URL <ww.ccscpetro.com/bell_nipple_flange.html>, 1 page.
Cudd Energy Services, "Cudd Energy Services Brochure," 2016, 8 pages.
Daniel, "Fundamentals of Orifice Meter Measurement," Daniel Measurement and Control White Papers, Emerson Process Management, 2010, 9 pages.
Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.
Edwards, "Construction de modèles stratigraphiques à partir de données éparses," Stratigraphie, Université de Lorraine, 2017, 133 pages, English abstract.
Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.
Forum Energy Technologies "Drill Pipe Float Valves," 2019, Catalog, 6 pages.
geodf.com [online], "GEO Drilling Fluids Manual: Drilling Practices to Reduce The Cost of PetroDrill Mud," Geo Drilling Fluids, Inc., available at URL <https://www.yumpu.com/en/document/read/21474235/petrodrill-brochure-geo-drilling-fluids-inc/6>, 1 page.
Halliburton, "Chemical-Injection Pump," Halliburton: Testing & Subsea, 2011, 2 pages.
Halliburton, "Coflexip Flexible Pipe: High Pressure Flexible Flow Lines," Halliburton: Testing & Subsea, Surface Well Testing, 2016, 2 pages.
Hernandez-Vela et al., "Probability-based Dynamic Time Warping and Bag-of-Visual-and-Depth-Words for human Gesture Recognition in RGB-D," Pattern Recognition Letters, 2014, 50: 112-121, 10 pages.
Herrera and Bann, "Guided seismic-to-well tying based on dynamic time warping," SEG Las Vegas 2012 Annual Meeting, Nov. 2012, 6 pages.
Hydril "Checkguard" Kellyguard Drill Stem Valves, Catalog DSV 2003, Brochure, 9 pages.
Katch Kan Limited Catalog, "Upper Katch Kan," 2007, 2 pages.
Katch Kan, "Upper Katch Kan," Katch Kan Brochure, Product Info Sheet, Nov. 2019, 1 page.
Keogh and Ratanamahatana, "Exact indexing of dynamic time warping," Knowledge and Information Systems, Springer-Verlag London Ltd., 2004, 29 pages.
Kurz Instruments Inc., "Saudi Aramco Used Kurz to Help Monitor Flare Emissions," available on or before Feb. 18, 2021, retreived from URL <https://www.bing.com/search?q=http%3A%2F%2Fwww.kurzinstruments.com%2Fdownloads%2Fblog%2Fsaudi-aramco-uses-kurz-to-help-monitor-flare-emissions.pdf&qs=n&form=QBRE&msbsrank=7_7_0&sp=-1&pq=google&sc=7-6&sk=&cvid=3576A0E28A154B65BB8BDBF5B1BFCF69>, 6 pages.
Lallier et al., "3D Stochastic Stratigraphic Well Correlation of Carbonate Ramp Systems," IPTC 14046, International Petroleum Technology Conference (IPTC), presented at the International Petroleum Technology Conference, Dec. 7-9, 2009, 5 pages.
Lallier et al., "Management of ambiguities in magnetostratigraphic correlation," Earth and Planetary Science Letters, 2013, 371-372: 26-36, 11 pages.
Lallier et al., "Uncertainty assessment in the stratigraphic well correlation of a carbonate ramp: Method and application of the Beausset Basin, SE France," C. R. Geoscience, 2016, 348: 499-509, 11 pages.
Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.
Micro Motion, "Micro Motion ELITE Coriolis Flow and Density Meters," PS-00374, Product Data Sheet, Rev AM, Aug. 2021, Micromotion, Emerson, 56 pages.
Nakanishi and Nakagawa, "Speaker-Independent Word Recognition by Less Cost and Stochastic Dynamic Time Warping Method," ISCA Archive, European Conference on Speech Technology, Sep. 1987, 4 pages.
packardusa.com [online], "Drop-in Check Valves," Packard International, available on or before Jul. 6, 2007, via Internet Archive: Wayback Machine URL <http://web.archive.org/web/20070706210423/http://packardusa.com/productsandservices5.asp>, retrieved on May 11, 2021, URL <www.packardusa.com/productsandservices5.asp>, 2 pages.
Panametrics, "Intrumentation for real-time flare system control," Baker Hughes Company <https://www.bakerhughesds.com/panametrics/flare-instrumentation>, 2021, 6 pages.
Pels et al., "Automated biostratigraphic correlation of palynological records on the basis of shapes of pollen curves and evaluation of next-best solutions," Paleogeography, Paleoclimatology, Paleoecology, 1996, 124: 17-37, 21 pages.
Pollack et al., "Automatic Well Log Correlation," AAPG Annual Convention and Exhibition, Apr. 3, 2017, 1 page, Abstract Only.
Proserv, "Sample Cylinder, Flow Through, Sulfinert Coasted, 100bar," Proserve, Producti Specification Sheet, ingenious simplicity, 1 page.

(56) References Cited

OTHER PUBLICATIONS

Ritchie et al., "Glossary of Petroleum Systems Reliability Analysis," Office of Research and Monitoring and Office of Water Program Operations U.S. Environmental Protection Agency, Aug. 1973, 2 pages.
Rudman and Lankston, "Stratigraphic Correlation of Well Logs by Computer Techniques," The American Association of Petroleum Geologists, Mar. 1973, 53:3 (557-588), 12 pages.
Sakoe and Chiba, "Dynamic Programming Algorithm Optimization for Spoken Word Recognition," IEEE Transactions on Acoustics, Speech and Signal Processing, ASSP-26:1, Feb. 1978, 7 pages.
Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.
Sayhi, "peakdet: Peak detection using MATLAB," Jul. 2012, 4 pages.
Scribd.com [online], "Milling Practices and Procedures," retrieved from URL <https://www.scribd.com/document/358420338/Milling-Rev-2-Secured>, 80 pages.
Silva and Koegh, "Prefix and Suffix Invariant Dynamic Time Warping," IEEE Computer Society, presented at the IEEE 16th International Conference on Data Mining, 2016, 6 pages.
Smith and Waterman, "New Stratigraphic Correlation Techniques," Journal of Geology, 1980, 88: 451-457, 8 pages.
Startzman and Kuo, "A Rule-Based System for Well Log Correlation," SPE Formative Evaluation, Society of Petroleum Engineers (SPE), Sep. 1987, 9 pages.
TAM International Inflatable and Swellable Packers, "TAM Scab Liner brochure," Tam International, available on or before Nov. 15, 2016, 4 pages.
Tomasi et al., "Correlation optimized warping and dynamic time warping as preprocessing methods for chromatographic data," Journal of Chemometrics, 2004, 18: 231-241, 11 pages.
Uchida et al., "Non-Markovian Dynamic Time Warping," presented at the 21st International Conference on Pattern Recognition (ICPR), Nov. 11-15, 2012, 4 pages.
Waterman and Raymond, "The Match Game: New Stratigraphic Correlation Algorithms," Mathematical Geology, 1987, 19:2, 19 pages.
Weatherford, "Micro-Seal Isolation System-Bow (MSIS-B)," Weatherford Swellable Well Construction Products, Brochure, 2009-2011, 2 pages.
Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.

* cited by examiner

ULTRASONIC FLOW CHECK SYSTEMS FOR WELLBORES

TECHNICAL FIELD

This disclosure relates to wellbore management, and particularly to performing flow check within a wellbore.

BACKGROUND

Wellbores are formed in subterranean zones (a formation, a portion of a formation or multiple formations) to produce hydrocarbons entrapped in the subterranean zones to the surface. When forming wellbores or when operating wellbores, the stability of well conditions is periodically checked. Flow check is one such stability test in which a fluid level within a wellbore is monitored. Often, a flow check is a manual operation performed by an operator who visually inspects fluid levels within the wellbore.

SUMMARY

This disclosure describes an ultrasonic flow check systems for wellbores.

Certain aspects of the subject matter described here can be implemented as a well tool system. The system includes a bell nipple attached to a well head of a wellbore at a surface. A rotary table is installed above the bell nipple such that the bell nipple is between the rotary table and the well head. A flow line is attached to a side surface of the bell nipple such that the flow line is between the rotary table and the well head. The flow line can permit flow of wellbore fluid into the bell nipple. An ultrasonic transceiver is attached to an inner surface of the bell nipple. The ultrasonic transceiver can transmit ultrasonic signals and receive ultrasonic response signals generated responsive to a reflection of the ultrasonic signals. An alarm is installed on the rotary table. The alarm is operatively coupled to the ultrasonic transceiver. A control system is operatively coupled to the ultrasonic transceiver and the alarm. The control system includes one or more computers, and a computer-readable medium (e.g., a non-transitory computer-readable medium) storing instructions executable by the one or more computers to perform operations. The operations include sending an instruction to the ultrasonic transceiver to transmit an ultrasonic signal into the bell nipple. The operations include receiving a signal from the ultrasonic transceiver. The received signal is representative of an ultrasonic response signal received by the ultrasonic transceiver responsive to a reflection of the transmitted ultrasonic signal by a wellbore fluid within the bell nipple. The ultrasonic response signal represents a fluid level of the wellbore fluid within the bell nipple. The operations include determining, based on the transmitted ultrasonic signal and the received ultrasonic response signal, whether the fluid level within the bell nipple is static or mobile.

An aspect combinable with any other aspect can include the following features. The control system is installed on the rotary table.

An aspect combinable with any other aspect can include the following features. The alarm includes a visual alarm.

An aspect combinable with any other aspect can include the following features. The alarm includes an audible alarm.

An aspect combinable with any other aspect can include the following features. The transmitted ultrasonic signal is an ultrasonic status signal. Before sending the instructions to the ultrasonic transceiver to transmit the ultrasonic status signal, the operations include sending an instruction to the ultrasonic transceiver to transmit an ultrasonic test signal into the bell nipple. The operations include receiving a signal from the ultrasonic transceiver. The received signal is representative of an ultrasonic response-to-status signal received by the ultrasonic transceiver responsive to a reflection of the ultrasonic test signal by the wellbore fluid within the bell nipple. The operations include determining, based on the ultrasonic test signal and the ultrasonic response-to-status signal, that the fluid level is ready to be determined by transmitting the ultrasonic status signal.

An aspect combinable with any other aspect can include the following features. To determine, based on the ultrasonic test signal and the ultrasonic response-to-status signal, that the fluid level is ready to be determined by transmitting the ultrasonic status signal, the operations include determining that the level of the wellbore fluid within the bell nipple represented by the ultrasonic response-to-status signal matches a threshold fluid level.

An aspect combinable with any other aspect can include the following features. The operations include, in response to determining that the level of the wellbore fluid within the bell nipple represented by the ultrasonic response-to-status signal matches the threshold fluid level, triggering the visual alarm.

An aspect combinable with any other aspect can include the following features. The operations include, after receiving the signal from the ultrasonic transceiver, which is representative of the ultrasonic response signal received by the ultrasonic transceiver responsive to the reflection of the transmitted ultrasonic signal by the wellbore fluid within the bell nipple, determining that the fluid level within the bell nipple is mobile. In response to determining that the fluid level within the bell nipple is mobile, the operations include triggering the audible alarm.

An aspect combinable with any other aspect can include the following features. To determine, based on the transmitted ultrasonic signal and the received ultrasonic response signal, whether the fluid level within the bell nipple is static or mobile, the operations include determining whether a magnitude of the ultrasonic response signal remains constant over time or varies over time.

An aspect combinable with any other aspect can include the following features. The operations include determining that the magnitude of the ultrasonic response signal remains constant over time. In response to determining that the magnitude of the ultrasonic response signal remains constant over time, the operations include not triggering the alarm.

An aspect combinable with any other aspect can include the following features. The operations include determining that the magnitude of the ultrasonic response signal varies over time. In response to determining that the magnitude of the ultrasonic response signal varies over time, the operations include triggering the alarm.

Certain aspects of the subject matter described here can be implemented as a method. An ultrasonic transceiver is installed within an inner surface of a bell nipple attached to a well head of a wellbore at a surface. The bell nipple receives wellbore fluid from a flow line attached to a side surface of the bell nipple. An alarm is installed on a rotary table installed above the bell nipple such that the bell nipple is between the rotary table and the well head. A ultrasonic signal is caused to be transmitted, by the ultrasonic transceiver, into the bell nipple. The ultrasonic signal is reflected by the wellbore fluid within the bell nipple resulting in an ultrasonic response signal. The ultrasonic response signal is caused to be received by the ultrasonic transceiver. Based on the ultrasonic response signal, it is determined whether the fluid level within the bell nipple is static or mobile.

An aspect combinable with any other aspect can include the following features. The transmitted ultrasonic signal is an ultrasonic status signal. Before transmitting the ultrasonic status signal, the ultrasonic transceiver is caused to transmit an ultrasonic test signal into the bell nipple. The ultrasonic transceiver is caused to receive an ultrasonic response-to-status signal responsive to a reflection of the ultrasonic test signal by the wellbore fluid within the bell nipple. Based on the ultrasonic test signal and the ultrasonic response-to-status signal, it is determined that the fluid level is ready to be determined by transmitting the ultrasonic status signal.

An aspect combinable with any other aspect can include the following features. To determine, based on the ultrasonic test signal and the ultrasonic response-to-status signal, that the fluid level is ready to be determined by transmitting the ultrasonic status signal, it is determined that the level of the wellbore fluid within the bell nipple represented by the ultrasonic response-to-status signal matches a threshold fluid level.

An aspect combinable with any other aspect can include the following features. In response to determining that the level of the wellbore fluid within the bell nipple represented by the ultrasonic response-to-status signal matches the threshold fluid level, the visual alarm is triggered.

An aspect combinable with any other aspect can include the following features. After determining that the fluid level is ready to be determined by transmitting the ultrasonic status signal, it is determined that the fluid level within the bell nipple is mobile. In response to determining that the fluid level within the bell nipple is mobile, the audible alarm is triggered.

An aspect combinable with any other aspect can include the following features. To determine, based on the ultrasonic response signal, whether the fluid level within the bell nipple is static or mobile, it is determined whether a magnitude of the ultrasonic response signal remains constant over time or varies over time.

An aspect combinable with any other aspect can include the following features. It is determined that the magnitude of the ultrasonic response signal remains constant over time. In response to determining that the magnitude of the ultrasonic response signal remains constant over time, the alarm is not triggered.

An aspect combinable with any other aspect can include the following features. It is determined that the magnitude of the ultrasonic response signal varies over time. In response to determining that the magnitude of the ultrasonic response signal varies over time, the alarm is triggered.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

A flow check operation is performed by stopping wellbore operations (e.g., drilling, tripping, circulating or similar wellbore operations) and by monitoring to see if the wellbore is static or mobile (i.e., not static). The flow check operation is performed to ensure that the wellbore is stable. A manual flow check operation is performed by an operator who visually observes (sometimes with a flashlight) the wellbore fluid from a rig floor. In particular, the operator observes the wellbore fluid level within a bell nipple, which is a section of a large diameter tubular fitted to the top of the blowout preventers. If the wellbore fluid level is static in the bell nipple, then the operator concludes that the wellbore itself is static.

This disclosure describes an ultrasonic flow check system deployed to use ultrasonic signals to perform the flow check operation. Implementing the techniques described in this disclosure can yield accurate flow check results, which are sometimes better than the results of a manual flow check by a human operator. The techniques can prevent wellbore incidents such as blow out. Also, the techniques can warn an operator by sound and light in case the operator fails to detect blow out.

Figure 1:
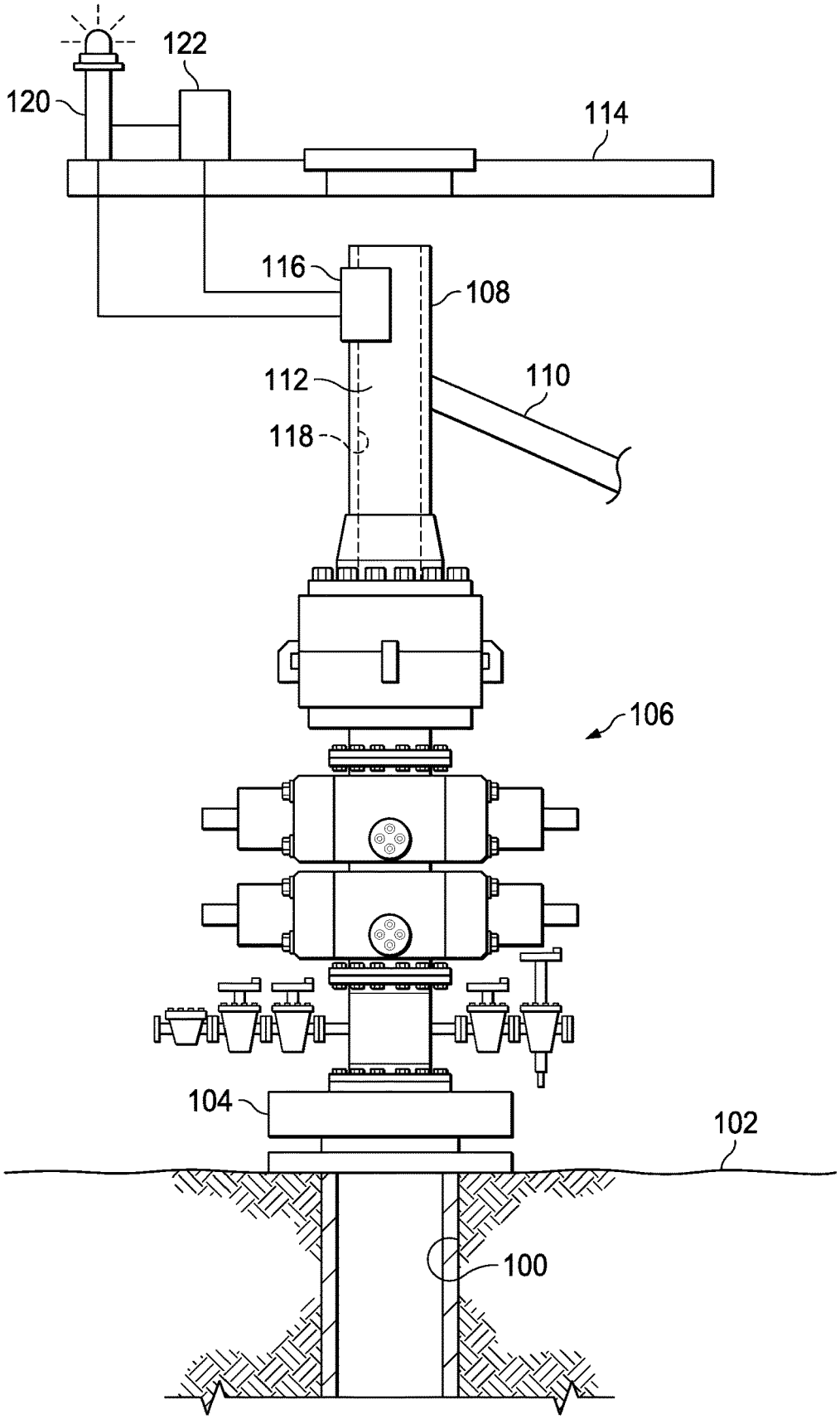
FIG. 1 is a schematic diagram of an example of an ultrasonic flow check system installed within a wellbore bell nipple.

FIG. 1 is a schematic diagram of an example of an ultrasonic flow check system installed within a wellbore bell nipple. The ultrasonic flow check system is a well tool system that is deployed to perform a flow check operation as described below. The ultrasonic flow check system is deployed in a wellbore 100 formed from a surface 100 of the Earth and extending into a subterranean zone (not shown). A well head 104 is installed at the surface 102 at the inlet to the wellbore 102. The well head 104 includes flow components (e.g., spools, valves, and similar components) operated to control pressure in the wellbore 100. A blow out preventer 106 is installed above the well head 104 such that the well head 104 is between the blow out preventer 106 and the surface 102. The blow out preventer 106 includes a valve at the top of the wellbore 102 to allow an operator to close the wellbore 102 upon loss of control of wellbore fluids flowing through the wellbore 102.

A bell nipple 108 is attached to the well head 104, particularly to the top of the blow out preventer 106. The bell nipple 108 is an elongated hollow tubular defining an interior volume. A flow line 110 is attached to the bell nipple 108. Specifically, an inlet to the flow line 110 is attached to a side, circumferential surface 112 of the bell nipple 108. An outlet of the flow line 110 leads to wellbore equipment installed at the surface 102, such as shale shakers and mud tanks (not shown). In operation, wellbore fluid (e.g., drilling fluid, production fluid or similar wellbore fluid) flows through the wellbore 100, through the well head 104, through the blow out preventer 106, through the bell nipple 108 and into the flow line 10.

A rotary table 114 is installed above the bell nipple 108 such that the bell nipple 108 is between the rotary table 114 and the well head 104. In some implementations, the ultrasonic flow check system is installed partly within the bell nipple 108 and partly on the rotary table 114. The ultrasonic flow check system includes an ultrasonic transceiver 116 attached to an inner surface 118 of the bell nipple 108. The ultrasonic transceiver 116 is configured to transmit ultrasonic signals and receive ultrasonic response signals generated responsive to a reflection of the ultrasonic signals. In some implementations, the ultrasonic transceiver 116 is attached near an upper end of the bell nipple 108 and is arranged such that the transceiver 116 transmits ultrasonic signals downward into the bell nipple and receives ultrasonic response signals flowing upward. By this arrangement, the ultrasonic transceiver 116 can transmit ultrasonic signals onto a surface of a wellbore fluid within the bell nipple 108 and receive ultrasonic response signals reflected at the surface of the wellbore fluid within the bell nipple 108.

The ultrasonic flow check system also includes an alarm 120 operatively coupled to the ultrasonic transceiver 116. In some implementations, the alarm 120 is installed on the rotary table 114. Alternatively, the alarm 120 can be installed on other wellbore equipment or at a location away from the wellbore 100 or wellbore equipment. In some implementations, the ultrasonic transceiver 116 and the alarm 120 are operatively coupled by wired connections. Alternatively, the connections can be wireless allowing the alarm 120 to be located at locations remote from the wellbore 100. In some implementations, the alarm 120 includes a visual alarm, e.g., a light, that turns on or off responsive to instructions. In some implementations, the alarm 120 includes an audible alarm, e.g., a speaker or other audio-producing device, that produces an audible sound responsive to instructions. In some implementations, the alarm 120 can include the visual alarm and the audible alarm.

In some implementations, the ultrasonic flow check system includes a control system 122 (or controller) that is operatively coupled (e.g., via wired or wireless connections) to the ultrasonic transceiver 116 and the alarm 120. For example, the control system 122 can be implemented as one or more computer systems and a computer-readable medium (e.g., non-transitory computer-readable medium) storing instructions executable by the one or more computers to perform operations, such as a flow check operation. Alternatively or in addition, the control system 122 can be implemented as processing circuitry, firmware, software, hardware or a combination of any of them. In some implementations, the control system 122 is a component of the ultrasonic transceiver 116 and resides in the same housing as the ultrasonic transceiver 116. Alternatively, the control system 122 can be a separate unit residing elsewhere, e.g., on the rotary table 122.

In operation, the operator decides to perform a flow check operation and ceases all flow through the wellbore 100. For example, if the operator is drilling the wellbore 100, then the operator can stop operation of the drilling equipment. In another example, if the operator is producing through the wellbore 100, then the operator can stop operation of any pumps or close flow control valves. Once flow through the wellbore 100 has ceased, the wellbore fluid rises to a location within the bell nipple 108. Once flow through the wellbore 100 has stopped, if the wellbore 100 is static, then the wellbore fluid levels within the wellbore 100 should be unchanged, i.e., the wellbore fluid levels should remain static. If the wellbore fluid levels are not static (i.e., the wellbore fluid level is mobile), then the wellbore 100 is unstable and remedial operations need to be initiated.

In some implementations, the operator can operate the control system 122 to perform the flow check operation. For example, in response to an instruction (e.g., a digital signal) from the operator (e.g., in response to being turned on), the control system 122 can send an instruction to the ultrasonic transceiver 116 to transmit an ultrasonic signal into the bell nipple 108. In response to receiving the instruction, the ultrasonic transceiver 116 generates and transmits an ultrasonic signal which travels downward into the bell nipple 108. The ultrasonic signal reflects on the surface of the wellbore fluid within the bell nipple 108 and produces an ultrasonic response signal, which travels upward toward the ultrasonic transceiver 116. Because the ultrasonic response signal is generated responsive to a reflection at a surface of the wellbore fluid within the bell nipple 108, the ultrasonic response signal represents a fluid level of the wellbore fluid within the bell nipple 108. The ultrasonic transceiver 116 receives the ultrasonic response signal and generates a signal (e.g., a digital signal) that is representative of the ultrasonic response signal. For example, a magnitude of the signal generated by the ultrasonic transceiver 116 can be directly proportional to a magnitude of the ultrasonic response signal. The control system 122 receives the signal and, using the signal, determines if the fluid level within the bell nipple 108 is static or mobile. In this manner, the ultrasonic flow check system determines whether the fluid level within the bell nipple 108 is static or mobile based on the ultrasonic signal transmitted into the bell nipple 108 and the ultrasonic response signal received responsive to a reflection of the transmitted ultrasonic signal on the surface of the wellbore fluid within the bell nipple 108.

Figure 2C:
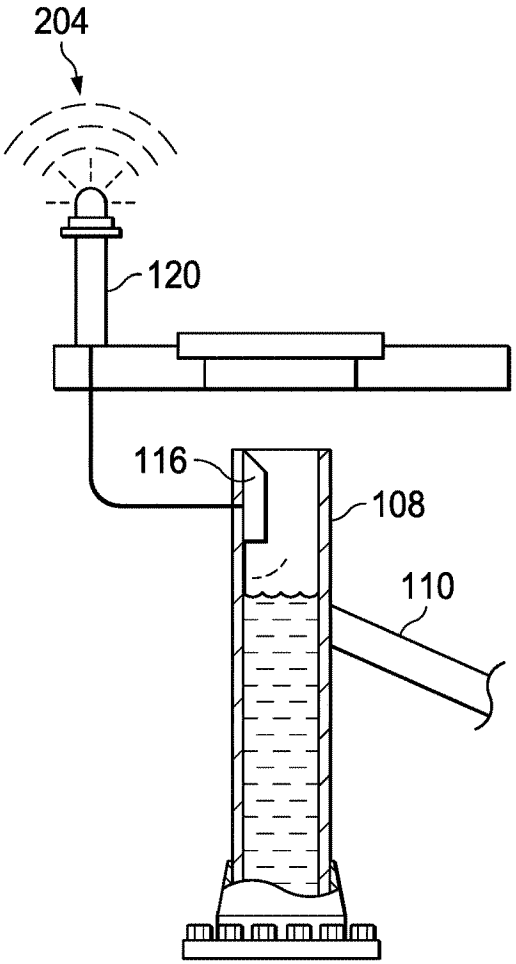
FIGS. 2A-2C are schematic diagrams of the ultrasonic flow check system of FIG. 1 in operation.
Figure 2B:
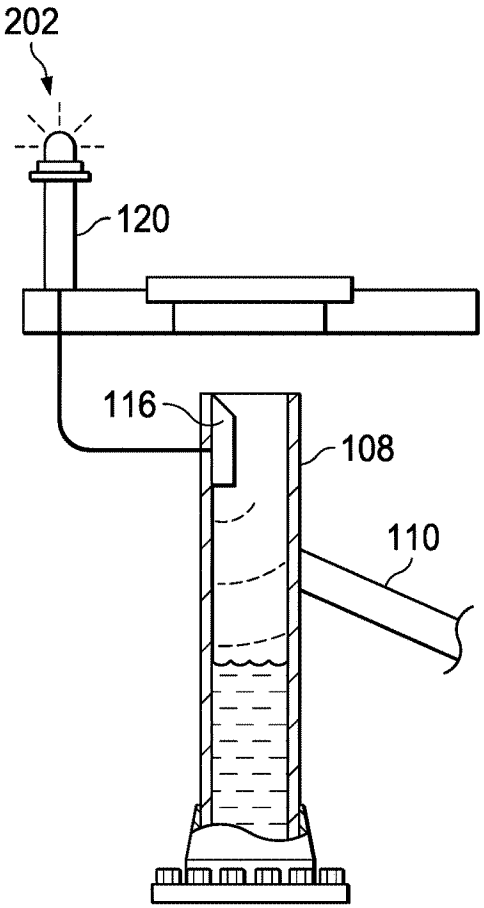
Figure 2A:
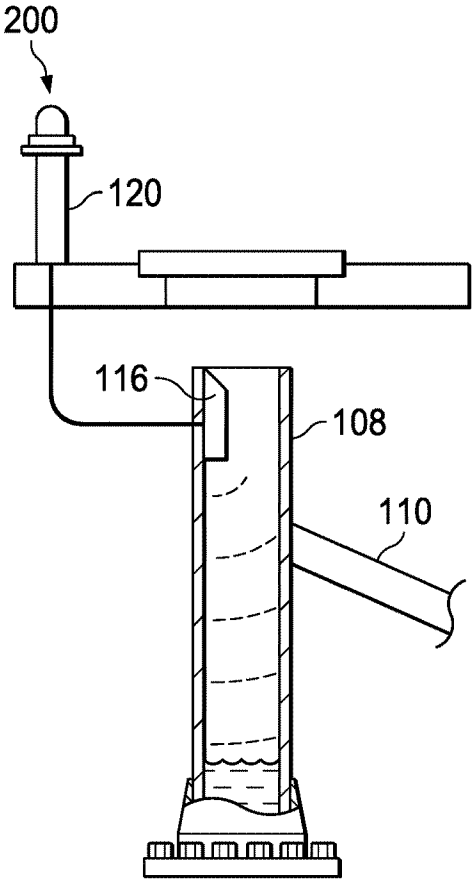

FIGS. 2A-2C are schematic diagrams of the ultrasonic flow check system of FIG. 1 in operation. FIG. 2A is a schematic diagram of an example in which the wellbore fluid level is static (i.e., flow check is negative), and no alarm is triggered. In operation, the ultrasonic transceiver 116 generates and continuously transmits an ultrasonic signal downward and into the bell nipple 108 toward the wellbore fluid in the bell nipple 108. The ultrasonic signal reflects on the surface of the wellbore fluid in the bell nipple 108 and generates an ultrasonic response signal. The ultrasonic transceiver 116 receives the ultrasonic response signal. The ultrasonic transceiver 116 generates a digital signal representative of the ultrasonic response signal. Because the wellbore fluid level is static, the magnitude of the ultrasonic response signal (and consequently the magnitude of the digital signal) does not change over time. Specifically, any change in the magnitude of the signal over time is less than a threshold value. Upon determining that the magnitude of the digital signal does not change over time, the control system 122 (FIG. 1) does not trigger the alarm 120.

In some implementations, the visual alarm (e.g., a light bulb) included in the alarm 120 can be turned off when the ultrasonic transceiver 116 transmits and receives the ultrasonic signals, and the control system 122 processes the digital signals received from the ultrasonic transceiver 116. Upon determining that the magnitude of the signals does not change over time, the control system 122 can transmit a signal to turn on the visual alarm (i.e., turn on the light bulb). The visual alarm being turned on can communicate to the wellbore operator that the wellbore fluid levels are static.

In some implementations, the visual alarm (e.g., the light bulb) included in the alarm 120 can be turned on when the ultrasonic transceiver 116 transmits and receives the ultrasonic signals, and the control system 122 processes the digital signals received from the ultrasonic transceiver 116. Upon determining that the magnitude of the signals does not change over time, the control system 122 can transmit a signal to turn off the visual alarm (i.e., turn off the light bulb). The visual alarm being turned off can communicate to the wellbore operator that the wellbore fluid levels are static.

FIG. 2B is a schematic diagram of an example in which the fluid level in the bell nipple 108 is tested to determine if the flow check operation can be commenced. After the wellbore operations have been ceased and perform the flow check operation is performed, the wellbore fluid level needs to settle to a location within the bell nipple 108. The ultrasonic flow check system can test if the wellbore fluid has settled to that location before performing the flow check operation. To do so, in some implementations, the visual alarm (e.g., the light bulb) is turned off. Then, the controller 122 can send an instruction to the ultrasonic transceiver 116 in response to which the ultrasonic transceiver 116 can transmit an ultrasonic status signal into the bell nipple 108. The ultrasonic test signal reflects on the surface of the wellbore fluid within the bell nipple 108 and generates an ultrasonic response-to-status signal, which is representative of a depth of the wellbore fluid within the bell nipple 108. The ultrasonic response-to-status signal travels upwards toward the ultrasonic transceiver 116. Upon receiving the ultrasonic response-to-status signal, the ultrasonic transceiver 116 generates a digital signal that is representative of the ultrasonic response-to-status signal. Thus, the digital signal also represents the depth of the wellbore fluid within the bell nipple 108. The controller 122 can store a threshold fluid level (i.e., a threshold depth) at which the wellbore fluid should reside within the bell nipple 108 to commence the flow check operation. If the depth of the wellbore fluid represented by the digital signal received from the ultrasonic transceiver matches the threshold depth stored by the control system 122 (FIG. 1), then the controller 122 can determine that the flow check operation can be commenced. In such a situation, the controller 122 can transmit a signal to turn on the visual alarm to communicate to the wellbore operator that the flow check operation can be commenced.

FIG. 2C is a schematic diagram of an example in which the wellbore fluid level is mobile (i.e., flow check is positive), and the alarm is triggered. The sequence of operations implemented to perform the flow check operation are the same as those described above with reference to FIG. 2B. However, in this example, the wellbore fluid level within the bell nipple 108 is not static. That is, the fluid level is rising or falling within the bell nipple 108 indicating that the wellbore 100 is unstable. In such situations, because the fluid level within the bell nipple 108 is rising or falling, a magnitude of the ultrasonic response signal varies over time, and, in turn, a magnitude of the digital signal received by the controller 122 varies over time. Specifically, any change in the magnitude of the signal over time is greater than a threshold value. Upon determining that the magnitude of the digital signal changes over time, the control system 122 (FIG. 1) triggers the alarm 120. For example, if the visual alarm was turned off when performing the flow check operation, the control system 122 (FIG. 1) can turn on the visual alarm (i.e., turn on the light bulb). If the visual alarm was turned on when performing the flow check operation, the control system 122 (FIG. 1) can turn off the visual alarm.

If the visual alarm was turned on when performing the flow check operation and a status operation was performed to determine if the flow check operation can be performed (as described above with reference to FIG. 2B), then the visual alarm would have been turned on when performing the flow check operation. In such examples, upon determining that the magnitude of the digital signal changes over time (i.e., the flow check operation is positive), the control system 122 (FIG. 1) can further turn on the audible alarm. A triggering of the visual alarm and the audible alarm can communicate to the wellbore operator that the flow check operation was positive. In response, the wellbore operator can implement remedial operations, such as closing the blow out preventer 106 (FIG. 1).

Figure 3:
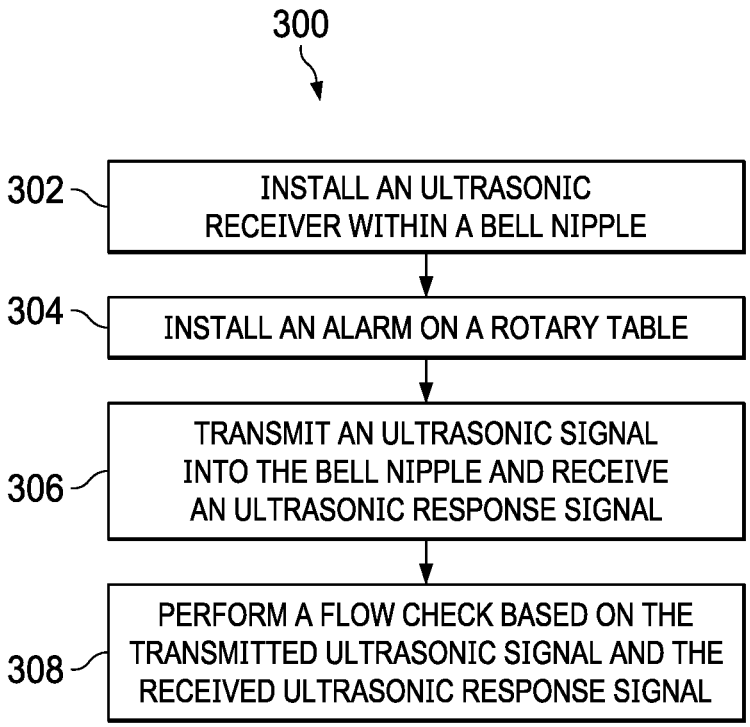
FIG. 3 is a flowchart of an example of a method of operating the ultrasonic flow check system of FIG. 1.

FIG. 3 is a flowchart of an example of a method 300 of operating the ultrasonic flow check system of FIG. 1. Certain portions of the method can be implemented by a wellbore operator. Other portions of the method can be implemented by one or more components of the ultrasonic flow check system described above with reference to FIG. 1.

At 300, an ultrasonic transceiver (e.g., ultrasonic transceiver 116) is installed within an inner surface of a bell nipple (e.g., bell nipple 108) attached to a well head of a wellbore at a surface. The bell nipple receives wellbore fluid from a flow line attached to a side surface of the bell nipple.

At 304, an alarm is installed on a rotary table (e.g., rotary table 114) installed above the bell nipple such that the bell nipple is between the rotary table and the well head. The alarm can include a visual alarm (e.g., a light bulb) and an audible alarm (e.g., a speaker or siren).

At 306, an ultrasonic signal is caused to be transmitted by the ultrasonic transceiver. To do so, for example, a control system (e.g., control system 122) can send an instruction to the ultrasonic transceiver in response to which the ultrasonic transceiver transmits the ultrasonic signal into the bell nipple. The ultrasonic signal is reflected by the wellbore fluid within the bell nipple resulting in an ultrasonic response signal. The ultrasonic transceiver receives the ultrasonic response signal.

At 308, a flow check operation is performed based on the transmitted ultrasonic signal and the received ultrasonic response signal. For example, the ultrasonic signal is transmitted into the bell nipple for a duration of time, either continuously or as periodic bursts. If the fluid level is static, then the distance traveled by the ultrasonic signal and the ultrasonic response signal remains the same over the duration of time. Consequently, a magnitude of the ultrasonic response signal remains constant for the duration of time (i.e., a difference between the magnitudes of the ultrasonic response signals received over the duration remains less than a threshold). Because the control system converts the ultrasonic response signal into a digital signal, a constant ultrasonic response signal results in a constant digital signal as well (i.e., i.e., a difference between the magnitudes of the digital signals received over the duration remains less than a threshold). A constant digital signal indicates that the wellbore fluid level is static and the flow check operation is negative. The alarm need not be triggered because the flow check operation is negative.

In contrast, if the fluid level is moving (e.g., rising) within the bell nipple 108, then the distance traveled by the ultrasonic signal and the ultrasonic response signal changes over the duration of time. Consequently, a magnitude of the ultrasonic response signal changes for the duration of time (i.e., a difference between the magnitudes of the ultrasonic response signals received over the duration exceeds a threshold). Because the control system converts the ultrasonic response signal into a digital signal, a changing ultrasonic response signal results in a changing digital signal as well (i.e., i.e., a difference between the magnitudes of the digital signals received over the duration exceeds a threshold). A changing digital signal indicates that the wellbore fluid level is not static (i.e., the fluid level is mobile), and the flow check operation is positive. The alarm can be triggered because the flow check operation is positive.

In some implementations, the alarm can be triggered in stages. For example, the visual alarm can be triggered when the flow check operation is performed and the audible alarm can be further triggered if the flow check operation is positive.

Thus, particular implementations of the subject matter have been described. Other implementations are within the scope of the following claims. In some cases, the actions recited in the claims can be performed in a different order and still achieve desirable results.

The invention claimed is:

1. A well tool system comprising:

a bell nipple attached to a well head of a wellbore at a surface;

a rotary table installed above the bell nipple such that the bell nipple is between the rotary table and the well head;

a flow line attached to a side surface of the bell nipple such that the flow line is between the rotary table and the well head, the flow line configured to permit flow of wellbore fluid into the bell nipple;

an ultrasonic transceiver attached to an inner surface of the bell nipple, the ultrasonic transceiver configured to transmit ultrasonic signals and receive ultrasonic response signals generated responsive to a reflection of the ultrasonic signals;

an alarm installed on the rotary table, the alarm operatively coupled to the ultrasonic transceiver; and a control system operatively coupled to the ultrasonic transceiver and the alarm, the control system comprising:

one or more computers, and a non-transitory computer-readable medium storing instructions executable by the one or more computers to perform operations comprising:

sending an instruction to the ultrasonic transceiver to transmit an ultrasonic signal into the bell nipple, receiving a signal from the ultrasonic transceiver, the received signal representative of an ultrasonic response signal received by the ultrasonic transceiver responsive to a reflection of the transmitted ultrasonic signal by a wellbore fluid within the bell nipple, wherein the ultrasonic response signal represents a fluid level of the wellbore fluid within the bell nipple, and determining, based on the transmitted ultrasonic signal and the received ultrasonic response signal, whether the fluid level within the bell nipple is static or mobile by determining whether a magnitude of the ultrasonic response signal remains constant over time or varies over time.

2. The well tool system of claim 1, wherein the control system is installed on the rotary table.

3. The well tool system of claim 1, wherein the alarm comprises a visual alarm.

4. The well tool system of claim 3, wherein the alarm comprises an audible alarm.

5. The well tool system of claim 4, wherein the transmitted ultrasonic signal is an ultrasonic status signal, wherein the operations comprise:

before sending the instruction to the ultrasonic transceiver to transmit the ultrasonic status signal, sending an instruction to the ultrasonic transceiver to transmit an ultrasonic test signal into the bell nipple;

receiving a signal from the ultrasonic transceiver, the received signal representative of an ultrasonic response-to-status signal received by the ultrasonic transceiver responsive to a reflection of the ultrasonic test signal by the wellbore fluid within the bell nipple; and determining, based on the ultrasonic test signal and the ultrasonic response-to-status signal, that the fluid level is ready to be determined by transmitting the ultrasonic status signal.

6. The well tool system of claim 5, wherein determining, based on the ultrasonic test signal and the ultrasonic response-to-status signal, that the fluid level is ready to be determined by transmitting the ultrasonic status signal comprises determining that the level of the wellbore fluid within the bell nipple represented by the ultrasonic response-to-status signal matches a threshold fluid level.

7. The well tool system of claim 6, wherein the operations comprise, in response to determining that the level of the wellbore fluid within the bell nipple represented by the ultrasonic response-to-status signal matches the threshold fluid level, triggering the visual alarm.

8. The well tool system of claim 7, wherein the operations comprise:

after receiving the signal from the ultrasonic transceiver, the received signal representative of the ultrasonic response signal received by the ultrasonic transceiver responsive to the reflection of the transmitted ultrasonic signal by the wellbore fluid within the bell nipple, determining that the fluid level within the bell nipple is mobile; and in response to determining that the fluid level within the bell nipple is mobile, triggering the audible alarm.

9. The well tool system of claim 1, wherein the operations comprise:

determining that the magnitude of the ultrasonic response signal remains constant over time; and in response to determining that the magnitude of the ultrasonic response signal remains constant over time, not triggering alarm.

10. The well tool system of claim 1, wherein the operations comprise:

determining that the magnitude of the ultrasonic response signal varies over time; and in response to determining that the magnitude of the ultrasonic response signal varies over time, triggering the alarm.

11. The well tool system of claim 1, wherein determining, based on the transmitted ultrasonic signal and the received ultrasonic response signal, whether the fluid level within the bell nipple is static or mobile comprises determining that the fluid level within the bell nipple is mobile, wherein the operations further comprise, in response to determining that the fluid level is mobile, causing flow of the wellbore fluid through the wellbore to be stopped.

12. A method comprising:

installing an ultrasonic transceiver within an inner surface of a bell nipple attached to a well head of a wellbore at a surface, wherein the bell nipple receives wellbore fluid from a flow line attached to a side surface of the bell nipple;

installing an alarm on a rotary table installed above the bell nipple such that the bell nipple is between the rotary table and the well head;

causing an ultrasonic signal to be transmitted, by the ultrasonic transceiver, into the bell nipple, wherein the ultrasonic signal is reflected by the wellbore fluid within the bell nipple resulting in an ultrasonic response signal;

causing the ultrasonic response signal to be received by the ultrasonic transceiver; and determining, based on the ultrasonic response signal, whether the fluid level within the bell nipple is static or mobile by determining whether a magnitude of the ultrasonic response signal remains constant over time or varies over time.

13. The method of claim 12, wherein the transmitted ultrasonic signal is an ultrasonic status signal, wherein the method comprises:

before transmitting the ultrasonic status signal, causing the ultrasonic transceiver to transmit an ultrasonic test signal into the bell nipple;

causing the ultrasonic transceiver to receive an ultrasonic response-to-status signal responsive to a reflection of the ultrasonic test signal by the wellbore fluid within the bell nipple; and determining, based on the ultrasonic test signal and the ultrasonic response-to-status signal, that the fluid level is ready to be determined by transmitting the ultrasonic status signal.

14. The method of claim 13, wherein determining, based on the ultrasonic test signal and the ultrasonic response-to-status signal, that the fluid level is ready to be determined by transmitting the ultrasonic status signal comprises determining that the level of the wellbore fluid within the bell nipple represented by the ultrasonic response-to-status signal matches a threshold fluid level.

15. The method of claim 14, wherein the operations comprise, in response to determining that the level of the wellbore fluid within the bell nipple represented by the ultrasonic response-to-status signal matches the threshold fluid level, triggering the visual alarm.

16. The method of claim 15, wherein the method comprises:

after determining that the fluid level is ready to be determined by transmitting the ultrasonic status signal, determining that the fluid level within the bell nipple is mobile; and in response to determining that the fluid level within the bell nipple is mobile, triggering the audible alarm.

17. The method of claim 12, wherein the method comprises:

determining that the magnitude of the ultrasonic response signal remains constant over time; and in response to determining that the magnitude of the ultrasonic response signal remains constant over time, not triggering alarm.

18. The method of claim 12, wherein the method comprises:

determining that the magnitude of the ultrasonic response signal varies over time; and in response to determining that the magnitude of the ultrasonic response signal varies over time, triggering the alarm.

19. The method of claim 12, wherein determining, based on the transmitted ultrasonic signal and the received ultrasonic response signal, whether the fluid level within the bell nipple is static or mobile comprises determining that the fluid level within the bell nipple is mobile, the method further comprising, in response to determining that the fluid level is mobile, causing flow of the wellbore fluid through the wellbore to be stopped.

* * * * *